US009203171B2

(12) United States Patent
Yu et al.

(10) Patent No.: US 9,203,171 B2
(45) Date of Patent: Dec. 1, 2015

(54) CABLE CONNECTOR ASSEMBLY HAVING SIMPLE WIRING ARRANGEMENT BETWEEN TWO END CONNECTORS

(71) Applicant: HON HAI PRECISION INDUSTRY CO., LTD., New Taipei (TW)

(72) Inventors: Le Yu, DongTai (CN); Chien-Chiung Wang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/449,385

(22) Filed: Aug. 1, 2014

(65) Prior Publication Data

US 2015/0038004 A1 Feb. 5, 2015

(30) Foreign Application Priority Data

Aug. 1, 2013 (CN) ..... 2013 1 0328862

(51) Int. Cl.
*H01R 12/73* (2011.01)
*H01R 12/62* (2011.01)
*H01R 24/64* (2011.01)

(52) U.S. Cl.
CPC ..... *H01R 12/73* (2013.01); *H01R 12/62* (2013.01); *H01R 24/64* (2013.01)

(58) Field of Classification Search
CPC combination set(s) only.
See application file for complete search history.

(56) References Cited

U.S. PATENT DOCUMENTS 6,893,285 B1 5/2005 Chiang
7,581,978 B1 * 9/2009 Briant ..... 439/358
7,618,264 B2 * 11/2009 Wu ..... 439/76.1
7,651,341 B2 * 1/2010 Wu ..... 439/76.1
7,651,342 B1 * 1/2010 Wu ..... 439/76.1
7,654,831 B1 * 2/2010 Wu ..... 439/76.1
7,803,010 B1 * 9/2010 Hwang ..... 439/497
7,883,341 B2 * 2/2011 Lang et al. ..... 439/76.1
7,938,669 B2 * 5/2011 Li et al. ..... 439/352
8,062,052 B2 * 11/2011 Wu ..... 439/352
8,147,255 B2 * 4/2012 Wu ..... 439/76.1
8,152,555 B2 * 4/2012 Wu ..... 439/352
8,157,580 B2 * 4/2012 Wu ..... 439/352
8,187,019 B2 * 5/2012 Reed et al. ..... 439/345
8,202,122 B2 * 6/2012 Wu ..... 439/607.47
8,226,441 B2 * 7/2012 Regnier et al. ..... 439/626
8,241,045 B2 * 8/2012 Reed et al. ..... 439/76.1
8,251,730 B2 * 8/2012 Wu ..... 439/345
8,251,733 B2 * 8/2012 Wu ..... 439/352
8,251,735 B2 * 8/2012 Wu ..... 439/353
8,267,713 B2 * 9/2012 Wu ..... 439/352

(Continued)

FOREIGN PATENT DOCUMENTS

TW I376989 11/2012

*Primary Examiner* — Ross Gushi
(74) *Attorney, Agent, or Firm* — Ming Chieh Chang; Wei Te Chung

(57) ABSTRACT

A cable connector assembly includes a first connector, a second connector, and a cable connecting the first connector to the second connector. The first connector includes a first printed circuit board, a second printed circuit board, and a connecting member between the first and the second printed circuit boards. The second connector includes a third printed circuit board and a fourth printed circuit board. The cable includes a number of signal wires for transmitting data signals and a number of control wires for transmitting control signals. The control wires includes a number of first control wires connecting the first and the third printed circuit boards and a number of second control wires connecting the second and the fourth printed circuit boards.

20 Claims, 8 Drawing Sheets

(56) References Cited

U.S. PATENT DOCUMENTS

| | | | | |
|---|---|---|---|---|
| 8,267,716 | B2 * | 9/2012 | Wu | 439/455 |
| 8,287,290 | B2 | 10/2012 | Cohen | |
| 8,292,637 | B2 * | 10/2012 | Wu | 439/76.1 |
| 8,303,314 | B2 * | 11/2012 | Wu | 439/76.1 |
| 8,337,233 | B2 * | 12/2012 | Wu | 439/345 |
| 8,360,799 | B2 * | 1/2013 | Wu | 439/358 |
| 8,366,456 | B2 * | 2/2013 | Wu | 439/76.1 |
| 8,393,913 | B2 * | 3/2013 | Wu | 439/345 |
| 8,414,324 | B2 * | 4/2013 | Reed et al. | 439/345 |
| 8,439,704 | B2 * | 5/2013 | Reed | 439/607.06 |
| 8,449,312 | B2 * | 5/2013 | Lang et al. | 439/352 |
| 8,475,198 | B2 * | 7/2013 | Wu | 439/352 |
| 8,475,199 | B2 * | 7/2013 | Wang et al. | 439/353 |
| 8,480,432 | B2 * | 7/2013 | Wu | 439/607.18 |
| 8,506,331 | B2 * | 8/2013 | Wu | 439/607.18 |
| 8,523,598 | B2 * | 9/2013 | Wu | 439/358 |
| 8,550,848 | B2 * | 10/2013 | Wu | 439/607.18 |
| 8,562,369 | B2 * | 10/2013 | Wu | 439/345 |
| 8,573,997 | B2 * | 11/2013 | Neer et al. | 439/345 |
| 8,585,426 | B2 * | 11/2013 | Zerebilov et al. | 439/370 |
| 8,597,055 | B2 * | 12/2013 | Regnier et al. | 439/626 |
| 8,678,839 | B2 * | 3/2014 | Reed et al. | 439/76.1 |
| 8,708,752 | B2 * | 4/2014 | Wu | 439/660 |
| 8,740,637 | B2 * | 6/2014 | Wang et al. | 439/352 |
| 8,764,491 | B2 * | 7/2014 | Wang et al. | 439/660 |
| 8,770,990 | B2 * | 7/2014 | Sytsma et al. | 439/76.1 |
| 8,821,168 | B2 * | 9/2014 | Reed et al. | 439/76.1 |
| 8,834,185 | B2 * | 9/2014 | Wu | 439/76.1 |
| 8,926,339 | B2 * | 1/2015 | Houtz | 439/76.1 |
| 9,017,091 | B2 * | 4/2015 | Zhu et al. | 439/352 |
| 2007/0111598 | A1 * | 5/2007 | Quilici | 439/595 |
| 2009/0247017 | A1 * | 10/2009 | Wu | 439/660 |
| 2009/0253292 | A1 * | 10/2009 | Wu | 439/493 |
| 2010/0203754 | A1 * | 8/2010 | Li et al. | 439/345 |
| 2011/0059645 | A1 * | 3/2011 | Wu | 439/460 |
| 2011/0086548 | A1 * | 4/2011 | Wu | 439/607.41 |
| 2011/0136368 | A1 * | 6/2011 | Wu | 439/345 |
| 2011/0183535 | A1 * | 7/2011 | Wu | 439/153 |
| 2011/0195586 | A1 * | 8/2011 | Wu | 439/152 |
| 2011/0195590 | A1 * | 8/2011 | Wu | 439/345 |
| 2011/0195614 | A1 * | 8/2011 | Wu | 439/676 |
| 2011/0212643 | A1 * | 9/2011 | Reed et al. | 439/345 |
| 2011/0223809 | A1 * | 9/2011 | Reed et al. | 439/626 |
| 2011/0237112 | A1 * | 9/2011 | Wu | 439/358 |
| 2011/0250778 | A1 * | 10/2011 | Wu | 439/345 |
| 2011/0256776 | A1 * | 10/2011 | Reed | 439/660 |
| 2011/0281455 | A1 * | 11/2011 | Wu | 439/345 |
| 2011/0294333 | A1 * | 12/2011 | Wu | 439/345 |
| 2011/0300735 | A1 * | 12/2011 | Wu | 439/345 |
| 2011/0306228 | A1 * | 12/2011 | Wu | 439/345 |
| 2011/0306244 | A1 * | 12/2011 | Zhang et al. | 439/624 |
| 2012/0015544 | A1 * | 1/2012 | Wu | 439/345 |
| 2012/0040550 | A1 * | 2/2012 | Wu | 439/352 |
| 2012/0040551 | A1 * | 2/2012 | Wu | 439/358 |
| 2012/0040552 | A1 * | 2/2012 | Wu | 439/358 |
| 2012/0052714 | A1 * | 3/2012 | Zerebilov et al. | 439/370 |
| 2012/0064779 | A1 * | 3/2012 | Wu | 439/676 |
| 2012/0094515 | A1 * | 4/2012 | Wu | 439/159 |
| 2012/0129396 | A1 * | 5/2012 | Wang et al. | 439/607.01 |
| 2012/0171879 | A1 * | 7/2012 | Wang et al. | 439/160 |
| 2012/0171903 | A1 * | 7/2012 | Wang et al. | 439/660 |
| 2012/0214324 | A1 * | 8/2012 | Wu | 439/271 |
| 2012/0214345 | A1 * | 8/2012 | Wu | 439/607.19 |
| 2012/0214350 | A1 * | 8/2012 | Wu | 439/676 |
| 2012/0264325 | A1 * | 10/2012 | Reed et al. | 439/345 |
| 2013/0095676 | A1 * | 4/2013 | Wu | 439/76.1 |
| 2013/0231011 | A1 * | 9/2013 | Sytsma et al. | 439/723 |
| 2014/0065856 | A1 * | 3/2014 | Regnier et al. | 439/108 |
| 2014/0193122 | A1 * | 7/2014 | Wu et al. | 385/89 |
| 2014/0322943 | A1 * | 10/2014 | Zhu et al. | 439/217 |
| 2014/0329405 | A1 * | 11/2014 | Hsieh | 439/485 |
| 2014/0335736 | A1 * | 11/2014 | Regnier et al. | 439/638 |
| 2015/0017836 | A1 * | 1/2015 | Wu et al. | 439/620.21 |
| 2015/0031245 | A1 * | 1/2015 | Wu et al. | 439/638 |
| 2015/0038004 | A1 * | 2/2015 | Yu et al. | 439/502 |

* cited by examiner

CABLE CONNECTOR ASSEMBLY HAVING SIMPLE WIRING ARRANGEMENT BETWEEN TWO END CONNECTORS

BACKGROUND OF THE INVENTION

1. Field of the Invention

The present invention relates to a connector assembly, and more particularly to a signal transmitting structure of the connector assembly.

2. Description of Related Arts

It is known for a SAS (Serial Attached SCSI) External cable assembly to have a wiring arrangement that data signals are transmitted between a first cable end connector and a second cable end connector. In particular, the first connector comprises a first (upper) printed circuit board (PCB) and a second (lower) PCB, and the second connector comprises a third (upper) PCB and a fourth (lower) PCB. Data signals are transmitted straightforwardly between the second and the fourth PCBs and between the first and the third PCBs. Therefore, cable wires are soldered accordingly without cross-soldering, e.g., cable wires soldered to the second PCB of the first connector and to both the fourth and the third PCBs of the second connector.

The specification of SAS-3, revision of Apr. 23, 2012, showed a SAS Internal cable connector assembly comprising a first connector, a second connector, and a cable connecting the first connector to the second connector. The first connector comprises a first (upper) printed circuit board and a second (lower) printed circuit board. The second connector comprises a third (upper) printed circuit board and a fourth (lower) printed circuit board. The cable includes a plurality of signal wires for transmitting data signals and several control wires. The control wires between the first and the fourth printed circuit board are crossed from upper to lower; the control wires between the second and the third printed circuit board are crossed from lower to upper. The manufacturing process of soldering the crossed control wires is complicated.

U.S. Pat. No. 8,287,290, issued on Oct. 16, 2012, discloses an interface connector for electrically connecting a first circuit board to a second circuit board. The interface connector provides a bridge for electrical circuits associated with electrical components on the first board to connect with electrical circuits associated with electrical components on the second board.

An improved connector assembly is desired to offer advantages over the related art.

SUMMARY OF THE INVENTION

An object of the present invention is to provide a cable connector assembly easy for soldering cable wires thereof.

To achieve the above-mentioned object, a cable connector assembly comprises: a first connector comprising a first printed circuit board (PCB), a second PCB below the first PCB, and a connecting member disposed between and electrically connecting the first PCB and the second PCB; a second connector comprising a third PCB and a fourth PCB below the third PCB; a cable connecting the first connector to the second connector, the cable comprising a plurality of signal wires for transmitting data signals and a plurality of control wires for transmitting control signals, the control wires comprising a plurality of first control wires connecting the first and the third PCBs and a plurality of second control wires connecting the second and the fourth PCBs.

According to the present invention, the connector assembly avoids the crossed soldering to simplify the manufacture procedure. It is more convenient because of using a flat cable instead of the core wires which are soldered separately.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to a preferred embodiment of the present invention.

Figure 1:
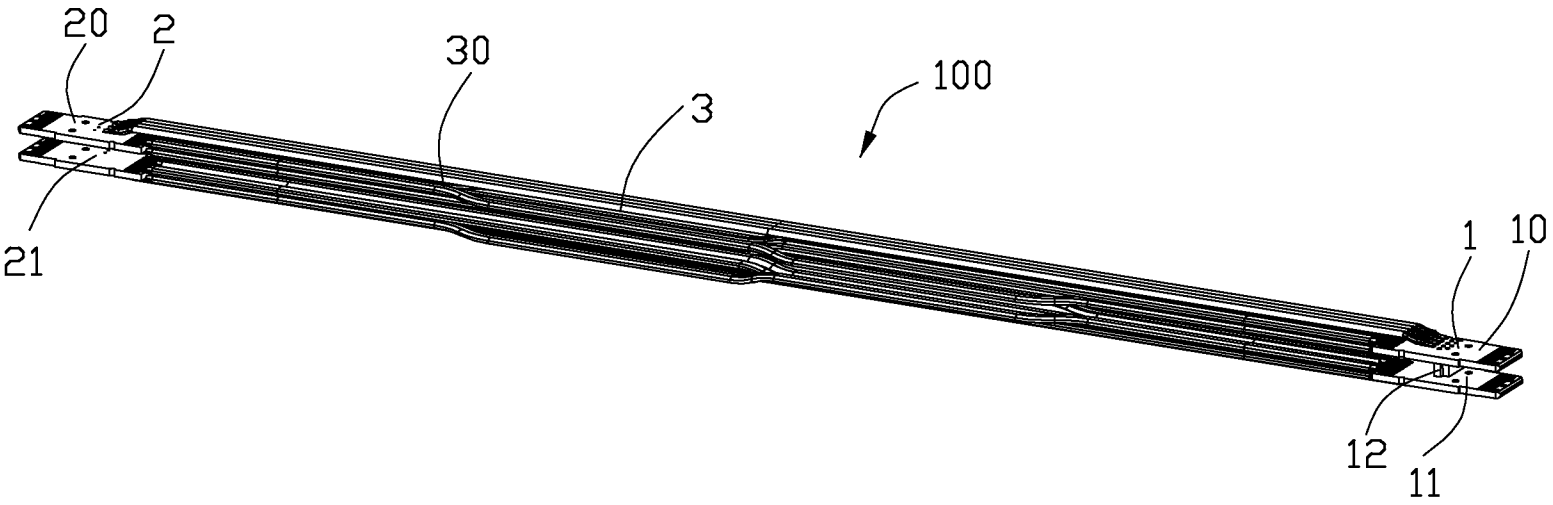
FIG. 1 is a perspective view of a cable connector assembly in accordance with the present invention.

Referring to FIG. 1, a cable connector assembly 100 comprises a first connector 1, a second connector 2, and a cable 3 connecting the first connector 1 to the second connector 2. Understandably, one of the first connector 1 and the second connector could be for an input purpose and the other for the output purpose, or in a reciprocal manner either wholly or partially. Anyhow, for easy illustration of the whole structural relation among the detailed components, the first connector 1 and the second connector 2 may be named respectively as the input connector and the output connector rather than using the order numerals.

Figure 2:
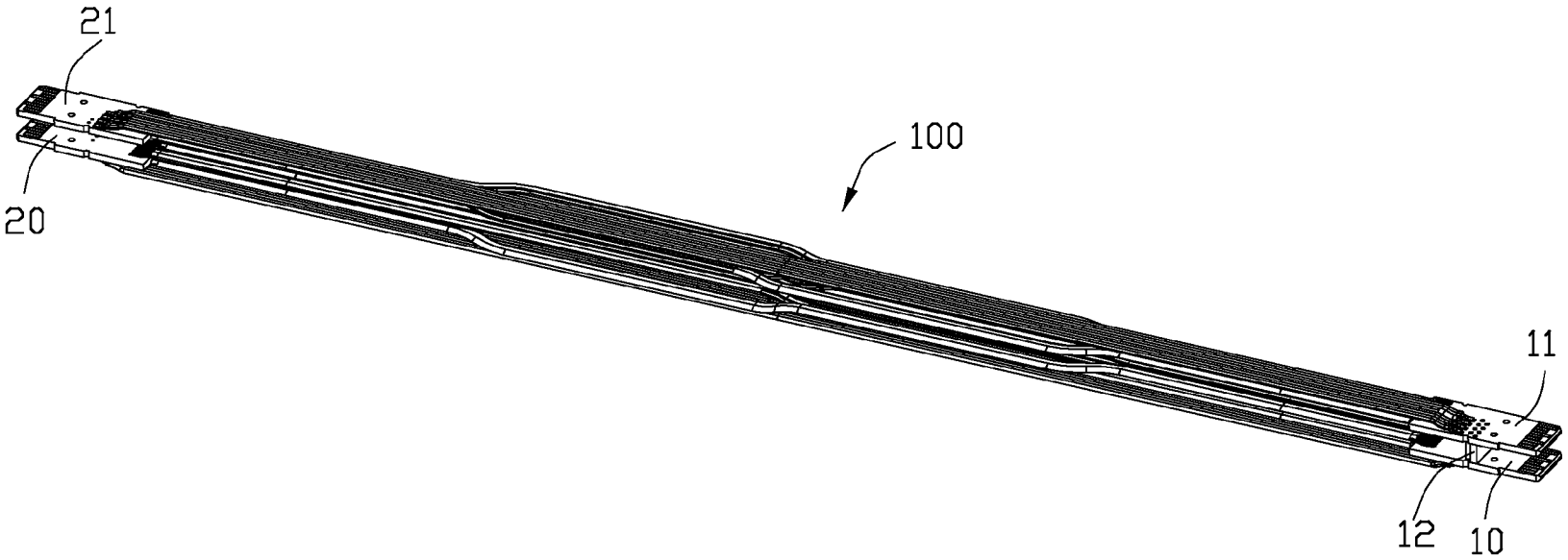
FIG. 2 is another perspective view of the connector assembly as shown in FIG. 1.
Figure 3:
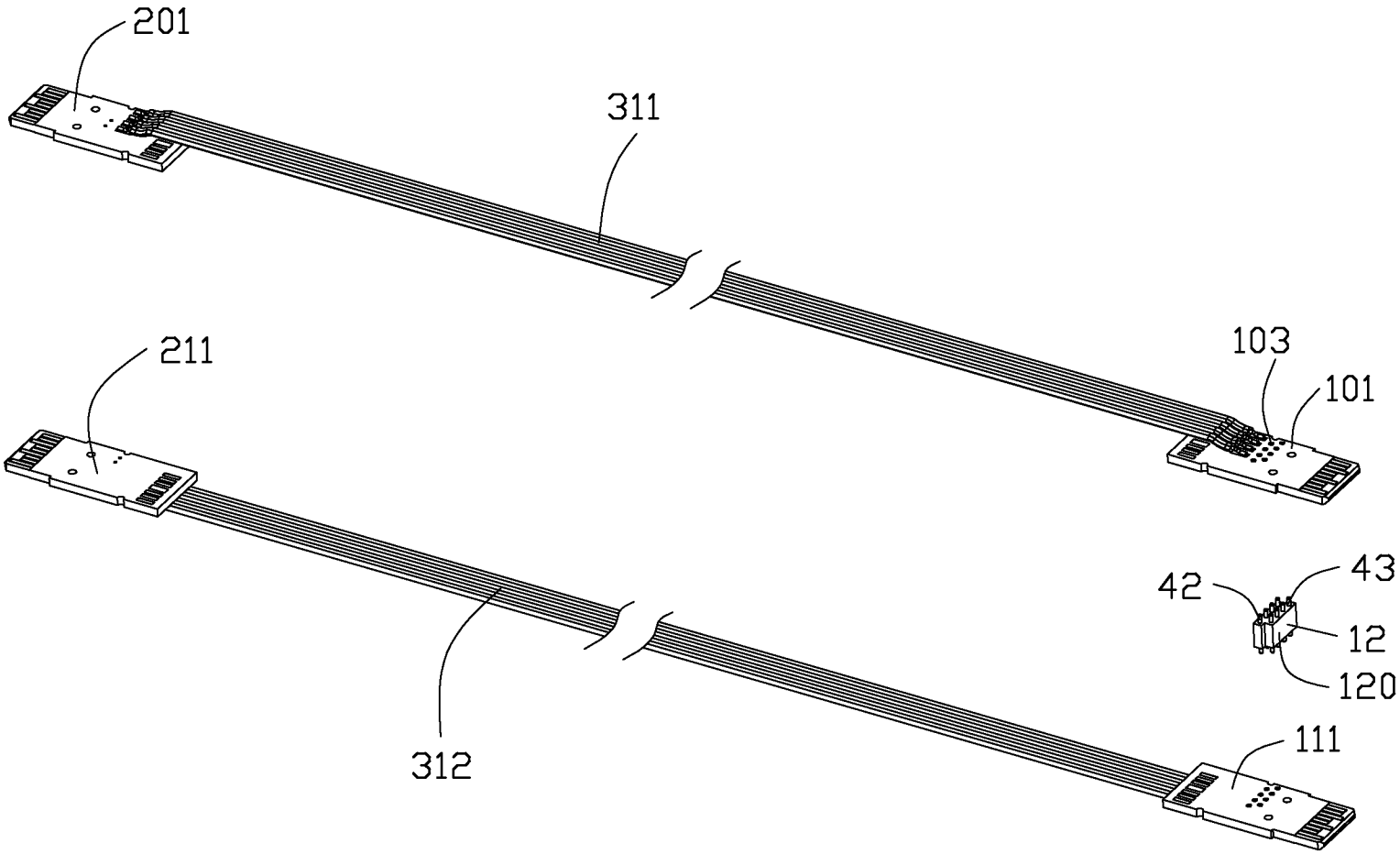
FIG. 3 is a partly exploded view of the connector assembly as shown in FIG. 1.

Referring to FIGS. 1 to 3, the first connector 1 comprises a first printed circuit board 10, a second printed circuit board 11 spaced apart from and disposed below the first printed circuit board 10, and a connecting member 12 electrically connecting the first and second printed circuit board 10,11. The connecting member 12 is disposed between the first and the second printed circuit board 10,11.

The first printed circuit board 10 comprises a first upper signal terminal 101 on an upper surface and a first lower signal terminal 102 on a lower surface of the first printed circuit board 10. A plurality of first terminal holes 103 are formed by passing through the upper surface and the lower surface of the first printed circuit board 10. A plurality of first conductive pads 104 are disposed behind the first terminal holes 103 on the first upper signal terminal 101. The second printed circuit board 11 comprises a second upper signal terminal 111 on the upper surface and a second lower signal terminal 112 on the lower surface of the second printed circuit board 11. A plurality of second terminal holes 113 are formed by passing through the upper surface and the lower surface of the second printed circuit board 11. A plurality of second conductive pads 114 are disposed behind the second terminal holes 113 on the second lower signal terminal 112.

Figure 8:
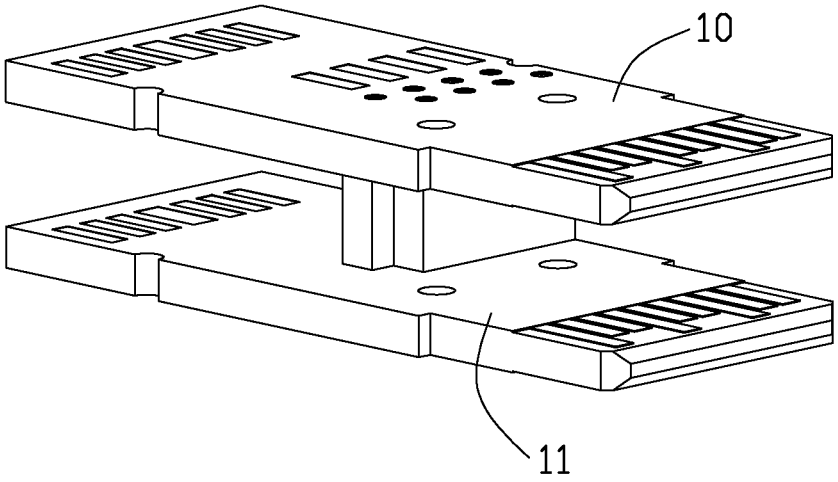
FIG. 8 is a perspective view of printed circuit boards and the connecting member of the connector assembly as shown in FIG. 1.

The connecting member 12 comprises a body portion 120, a plurality of contacts 4 held in the body portion 120. The contact 4 comprises a head portion 40 extending upwardly beyond a top of the body portion 120, a tail portion 41 extending downwardly beyond a bottom of the body portion 120, and a middle portion (not shown) connecting the head portion 40 and the tail portion 41. Referring to FIG. 8, the connecting member 12 is fixed between the first printed circuit board 10 and the second printed circuit board 11 by inserting the head portion 40 into the first terminal hole 103 and the tail portion 41 into the second terminal hole 113. The contacts 4 comprise a plurality of first contacts 42 and a plurality of second contacts 43. Each first contact 42 is staggered with the corresponding second contact 43.

The second connector 2 comprises a third printed circuit board 20 and a fourth printed circuit board 21 spaced apart from and disposed below the third printed circuit board 20. The third printed circuit board 20 comprises a third upper signal terminal 201 on the upper surface and a third lower signal terminal 202 on the lower surface of the third printed circuit board 20. A plurality of third conductive pads 203 are disposed on the third upper signal terminal 201. The fourth printed circuit board 21 comprises a fourth upper signal terminal 211 on the upper surface and a fourth lower signal terminal 212 on the lower surface of the fourth printed circuit board 21. A plurality of fourth conductive pads 213 are disposed on the fourth lower signal terminal 213.

Figure 5:
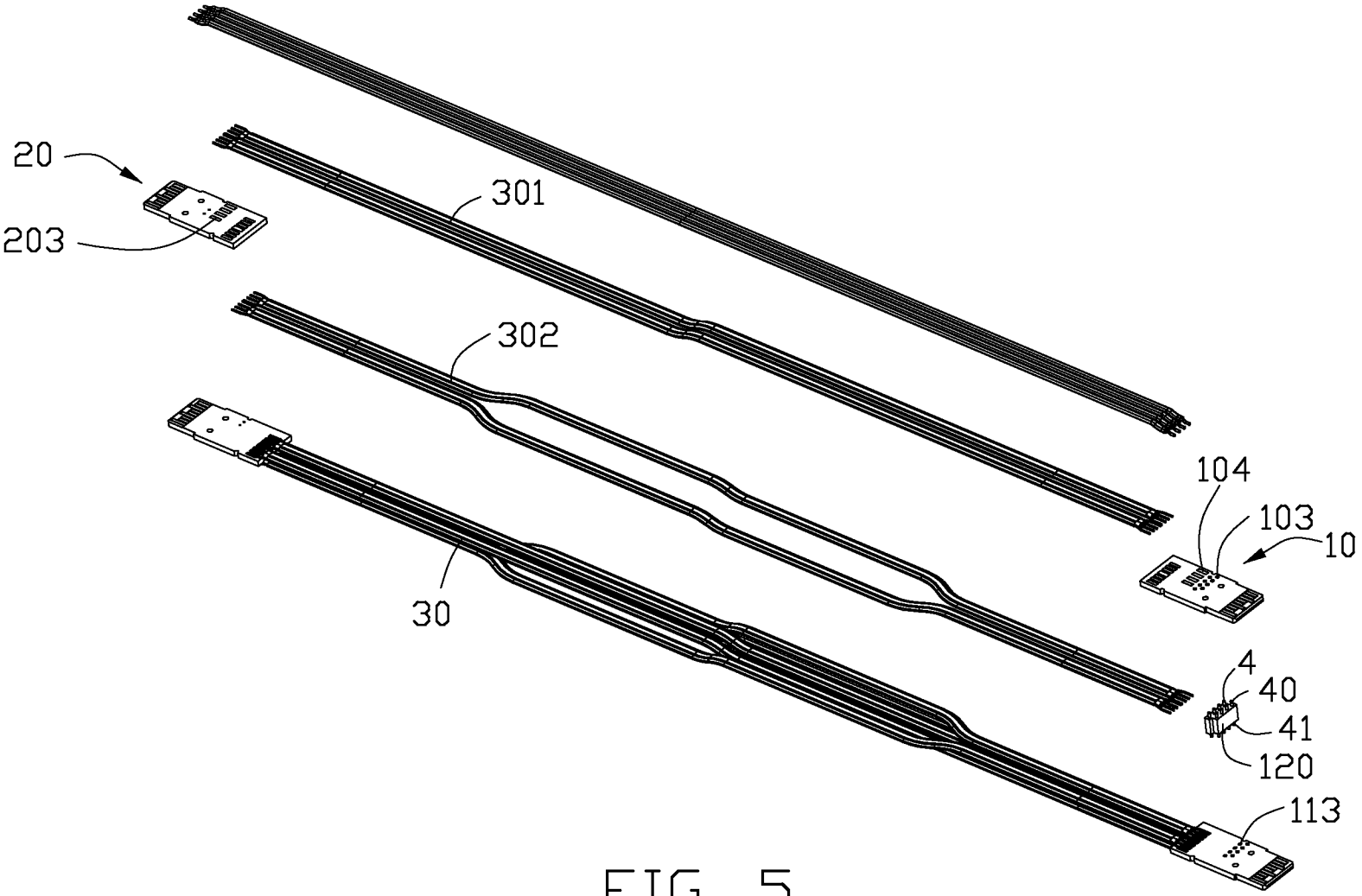
FIG. 5 is another partly exploded view of the connector assembly as shown in FIG. 1.
Figure 6:
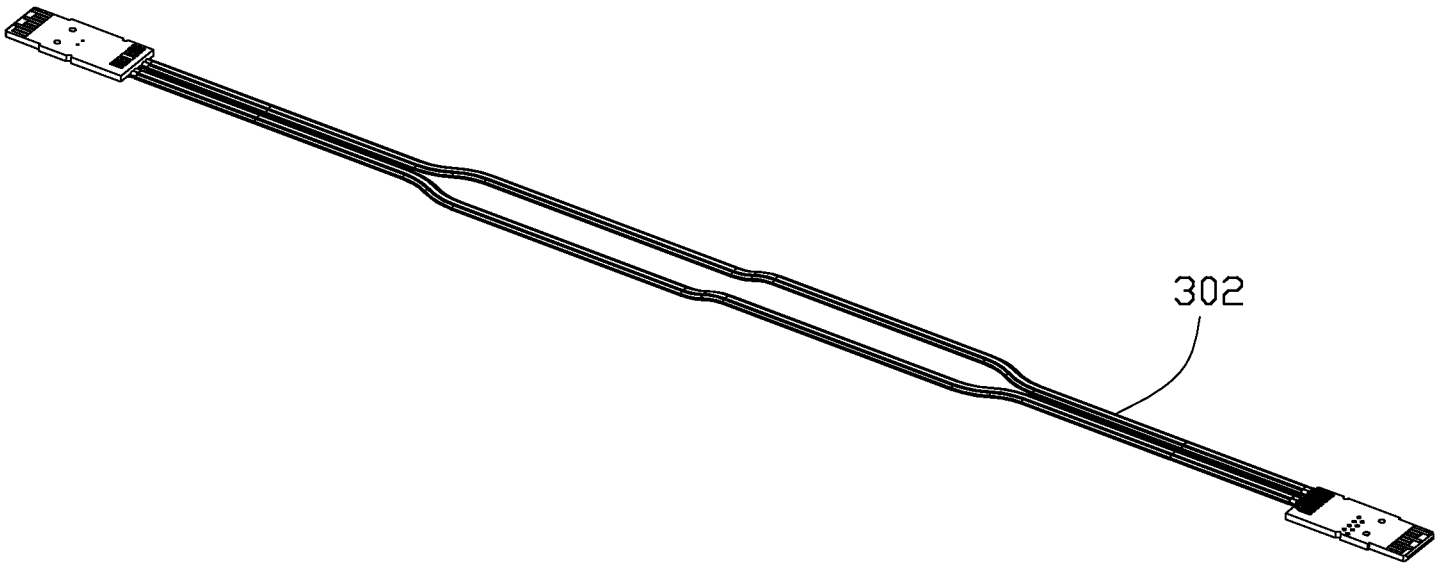
FIG. 6 is a perspective view of printed circuit boards connected to the signal wires of the connector assembly as shown in FIG. 1.
Figure 7:
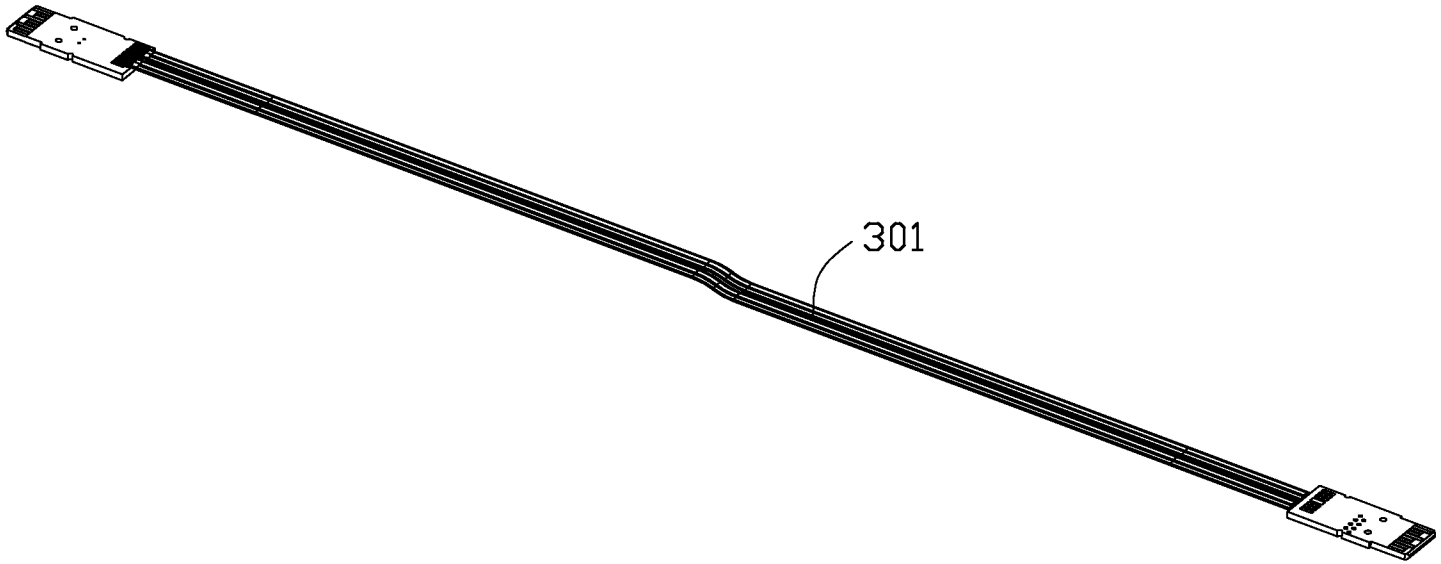
FIG. 7 is a perspective view of printed circuit boards connected to another signal wires of the connector assembly as shown in FIG. 1.

The cable 3 comprises a plurality of signal wires 30 for transmitting the data signals and a plurality of control wires 31 for transmitting the control signals. Referring to FIGS. 5 to 7, the signal wires 30 comprise a plurality of first signal wires 301 and a plurality of second signal wires 302. The first signal wires 301 connect the upper surface of the first printed circuit board 10 and the lower surface of the third printed circuit board 20. The second signal wires 302 connect the lower surface of the first printed circuit board 10 and the upper surface of the third printed circuit board 20. The signal wires 30 soldered between the second printed circuit board 11 and the fourth printed circuit boards 21 are in the same way of the signal wires 30 soldered between the first printed circuit board 10 and the third printed circuit board 20. The printed circuit boards are connected by the conductive pads disposed on the tail of the printed circuit boards.

Figure 4:
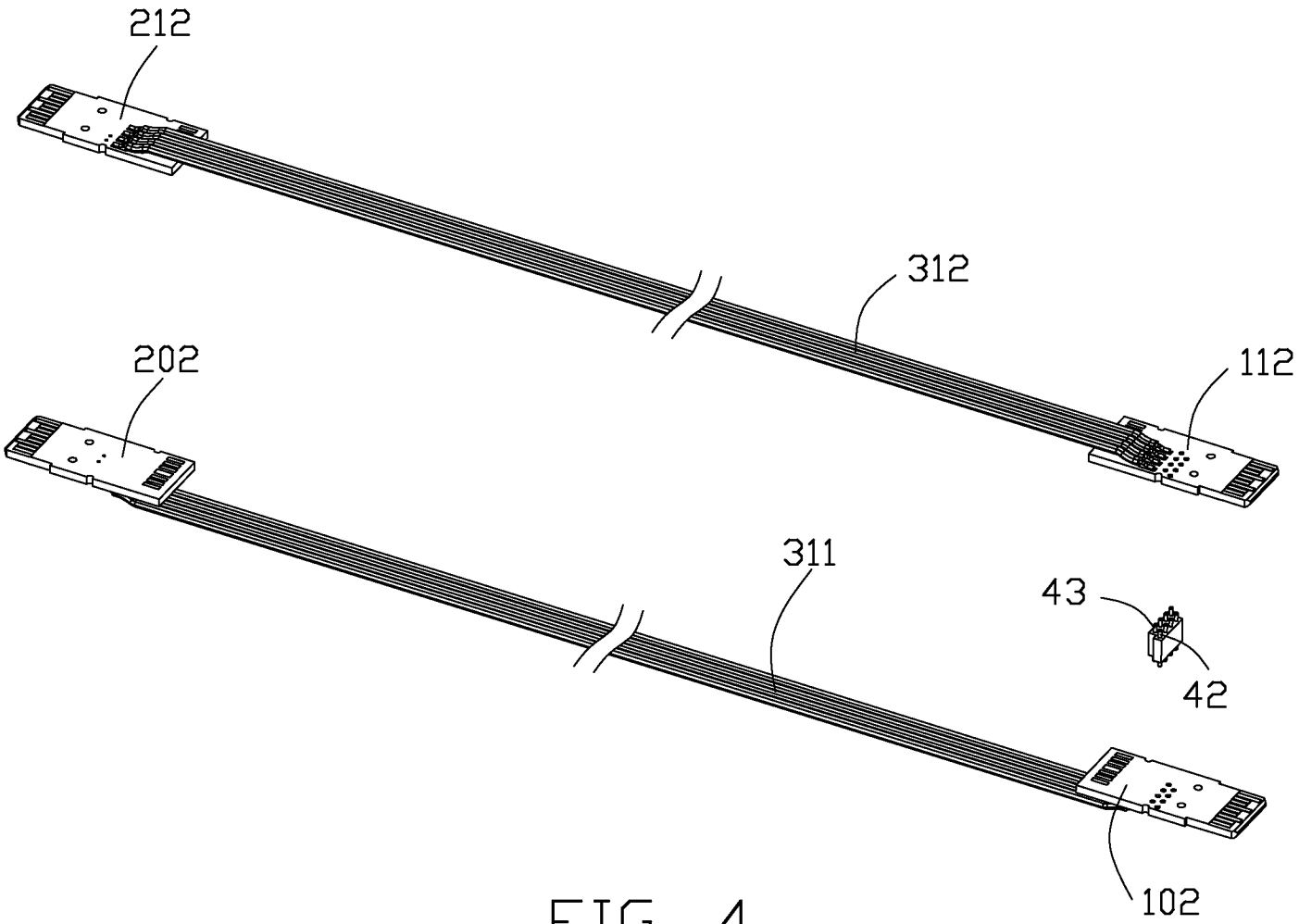
FIG. 4 is another partly exploded view of the connector assembly as shown in FIG. 3.

Referring to FIGS. 3 to 4, the control wires 31 comprise a plurality of first control wires 311 connecting the first and the third printed circuit board 10,20 and a plurality of second control wires 312 connecting the second and the fourth printed circuit board 11,21. The control wires 31 have a flat shape. The first and the second control wires 311,312 are arranged independently.

The second upper signal terminal 111 electrically connects with the third lower signal terminal 202 through the first control wires 311 and the connecting member 12. The second lower signal terminal 112 electrically connects with the third upper signal terminal 201 through the first control wires 311 and the connecting member 12. The first upper signal terminal 101 electrically connects with the fourth lower signal terminal 212 through the second control wires 312 and the connecting member 12. The first lower signal terminal 102 electrically connects with the fourth upper signal terminal 211 through the second control wires 312 and the connecting member 12.

More specifically, the second upper signal terminal 111 connects with the third lower signal terminal 202 through the connecting member 12, the first printed circuit board 10, the first control wire 311 and the third printed circuit board 20. The control signal from the second upper signal terminal 111 goes through the connecting member 12, the first printed circuit board 10, the first control wire 311, the third printed circuit board 20 in turn and finally arriving in the third lower signal terminal 202. The control signal from the third lower signal terminal 202 goes through the third printed circuit board 20, the first control wire 311, the first printed circuit board 10, the connecting member 12 in turn and finally arriving in the second upper signal terminal 111.

The second lower signal terminal 112 connects with the third upper signal terminal 201 through the second printed circuit board 11, the connecting member 12, the first printed circuit board 10 and the first control wire 311. The control signal from the second lower signal terminal 112 goes through the second printed circuit board 11, the connecting member 12, the first printed circuit board 10, the first control wire 311 in turn and finally arriving in the third upper signal terminal 201. The control signal from the third upper signal terminal 201 goes through the first control wire 311, the first printed circuit board 10, the connecting member 12, the second printed circuit board 11 in turn and finally arriving in the second lower signal terminal 112.

The first upper signal terminal 101 connects with the fourth lower signal terminal 212 through the first printed circuit board 10, the connecting member 12, the second printed circuit board 11 and the second control wire 312. The control signal from the first upper signal terminal 101 goes through the first printed circuit board 10, the connecting member 12, the second printed circuit board 11, and the second control wire 312 in turn and finally arriving in the fourth lower signal terminal 212. The control signal from the fourth lower signal terminal 212 goes through the second control wire 312, the second printed circuit board 11, the connecting member 12, and the first printed circuit board 10 in turn and finally arriving in the first upper signal terminal 101.

The first lower signal terminal 102 connects with the fourth upper signal terminal 211 through the connecting member 12, the second printed circuit board 11, the second control wire 312 and the fourth printed circuit board 21. The control signal from the first lower signal terminal 102 goes through the connecting member 12, the second printed circuit board 11, the second control wire 312, and the fourth printed circuit board 21 in turn and finally arriving in the fourth upper signal terminal 211. The control signal from the fourth upper signal terminal 211 goes through the fourth printed circuit board 21, the second control wire 312, the second printed circuit board 11, and the connecting member 12 in turn and finally arriving in the first lower signal terminal 102.

when assembling the connector assembly, firstly, fix the connecting member 12 between the first and the second printed circuit board 10,11. The head portion 40 is inserted into the first terminal holes 103 of the first printed circuit board 10 and the tail portion 41 is inserted into the second terminal holes 113 of the second printed circuit board 11. Secondly, solder one side of the first signal wires 301 to the upper surface of the first printed circuit board 10 and another side to the lower surface of the third printed circuit board 20. Solder one side of the second signal wires 302 to the lower surface of the first printed circuit board 10 and another side to the upper surface of the third printed circuit board 21. The signal wires 30 between the second and the fourth printed circuit board are the same. Then solder the one side of the first control wires 311 to the first conductive pads 104 of the first printed circuit board 10, and another side to the third conductive pads 203 of the third printed circuit board 20. Solder one side of the second control wires 312 to the second conductive pads 114 of the second printed circuit board 11, and another side to the fourth conductive pads 213 of the fourth printed circuit board 21.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a first connector comprising a first printed circuit board (PCB), a second PCB below the first PCB, and a connecting member disposed between and electrically connecting the first PCB and the second PCB;

a second connector comprising a third PCB and a fourth PCB below the third PCB;

a cable connecting the first connector to the second connector, the cable comprising a plurality of signal wires for transmitting data signals and a plurality of control wires for transmitting control signals, the control wires comprising a plurality of first control wires connecting the first and the third PCBs and a plurality of second control wires connecting the second and the fourth PCBs.

2. The connector assembly as recited in claim 1, wherein the control wires have a flat shape.

3. The connector assembly as recited in claim 2, wherein the first and the second control wires are arranged independently.

4. The connector assembly as recited in claim 3, wherein:

the second PCB comprises an upper signal terminal on an upper surface thereof and a lower signal terminal on a lower surface thereof;

the third PCB comprising an upper signal terminal on an upper surface thereof and a lower signal terminal on a lower surface thereof;

the upper signal terminal of the second PCB electrically connected with the lower signal terminal of the third PCB through the first control wires and the connecting member;

the lower signal terminal of the second PCB electrically connected with the upper signal terminal of the third PCB through the first control wires and the connecting member;

the first PCB comprising an upper signal terminal on an upper surface thereof and a lower signal terminal on a lower surface thereof;

the fourth PCB comprising an upper signal terminal on an upper surface thereof and a lower signal terminal on a lower surface thereof;

the upper signal terminal of the first PCB electrically connected with the lower signal terminal of the fourth PCB through the second control wires and the connecting member; and the lower signal terminal of the first PCB electrically connected with the upper signal terminal of the fourth PCB through the second control wires and the connecting member.

5. The connector assembly as recited in claim 4, wherein the connecting member comprises a body portion and a plurality of contacts held in the body portion, the contact comprising a head portion extending upwardly beyond a top of the body portion, a tail portion extending downwardly beyond a bottom of the body portion, and a middle portion connecting the head portion and the tail portion.

6. The connector assembly as recited in claim 5, wherein the lower signal terminal of the second PCB connects with the upper signal terminal of the third PCB through the second PCB, the connecting member, the first PCB, and the first control wire.

7. The connector assembly as recited in claim 5, wherein the upper signal terminal of the second PCB connects with the lower signal terminal of the third PCB through the connecting member, the first PCB, the first control wire, and the third PCB.

8. The connector assembly as recited in claim 7, wherein the upper signal terminal of the first PCB connects with the lower signal terminal of the fourth PCB through the first PCB, the connecting member, the second PCB, and the second control wire.

9. The connector assembly as recited in claim 6, wherein the lower signal terminal of the first PCB connects with the upper signal terminal of the fourth PCB through the connecting member, the second PCB, the second control wire, and the fourth PCB.

10. An electrical connector assembly comprising:

an output connection device including a first output PCB (Printed Circuit Board) and a second output PCB structurally spaced from each other while mechanically; and an input connection device spaced from the output connection device while mechanically and electrically linked to said output connection device via a cable set, said input connection device including a first input PCB and a second input PCB spaced from each other;

an electrical connecting member mechanically and electrically connected either between the first output PCB and the second output PCB of the output connection device, or between the first input PCB and the second input PCB of the input connection device;

said cable set including a first set of cable mechanically and electrically linked between said first output PCB and said first input PCB, and a second set of cable mechanically and electrically linked to said second output PCB and said second input PCB; and the first set of cable including a plurality of first control wires, the second set of cable including a plurality of second control wires, said first control wires and said second control wires being not intersected with each other while switching control signals which are transmitted by both said first control wires and said second control wires from the first input PCB to the second output PCB and from the second input PCB to the first output PCB, via said connecting member.

11. The electrical connector assembly as claimed in claim 10, wherein the connecting member is located between the first output PCB and the second output PCB so as to have said first control wires electrically connected to said second output PCB and have said second control wires electrically connected to said first output PCB via said connecting member.

12. The electrical connector assembly as claimed in claim 10, where said connecting member is of one piece with two groups of terminals respectively cooperating with said first set of cable and said second set of cable.

13. The electrical connector assembly as claimed in claim 10, wherein said first set of cable further includes a plurality of first signal wires which are divided into two groups intersected with each other in a direction along which two opposite surfaces of the first output PCB or the first input PCB are spaced from each other.

14. The electrical connector assembly as claimed in claim 13, wherein said two groups are further intersected with each other in another direction perpendicular to said direction.

15. The electrical connector assembly as claimed in claim 13, wherein the first control wires are located on an outer side with regard to the first signal wires in said direction.

16. The electrical connector assembly as claimed in claim 13, wherein said second set of cable further includes a plurality of second wires which are divided into two groups intersected with each other in a direction along which two opposite surfaces of the second output PCB or the second input PCB are spaced from each other, and the first control wires cooperate with the second control wires to commonly sandwich both said first signal wires and said second signal wires therebetween in the direction.

17. The electrical connector assembly as claimed in claim 13, wherein the first signal wires are connected to the first output PCB at a position behind another position where the first control wires are connected.

18. An electrical connector assembly comprising:

opposite input and output PCBs (Printed Circuit Boards) linked to each other via a cable set, said cable set including a plurality of control wires and a plurality of signal wires, the control wires commonly connected to only one surface of the input PCB and only one surface of output PCB while the signal wires connected to both opposite two surfaces of the input PCB and both opposite two surfaces of the output PCB; wherein said signal wires are divided into two groups intersected with each other in a vertical direction so as to switch connection positions on said two opposite surfaces of the input PCB to said two opposite surfaces of the output PCB in a reverse manner.

19. The electrical connector assembly as claimed in claim 18, wherein said two groups are further intersected with each other in a lengthwise direction along which said inner PCB and said output PCB are spaced from each other.

20. The electrical connector assembly as claimed in claim 18, further including a connecting member mounted upon one of the input PCB and the output PCB so as to electrically connect the control wires to the other surface of the output PCB.

* * * * *